United States Patent [19]

Hanazato

[11] Patent Number: 4,466,215

[45] Date of Patent: Aug. 21, 1984

[54] MINIATURE TOY VEHICLE ASSEMBLY

[75] Inventor: Hiroshi Hanazato, Tokyo, Japan

[73] Assignee: Buddy L Corporation, New York, N.Y.

[21] Appl. No.: 388,255

[22] Filed: Jun. 14, 1982

[51] Int. Cl.[3] ..... A63H 17/26

[52] U.S. Cl. ..... 446/469; 446/471

[58] Field of Search ..... 46/223, 222, 221, 201, 46/17

[56] References Cited

U.S. PATENT DOCUMENTS

| | | | |
|---|---|---|---|
| 1,905,649 | 4/1933 | Peake | 46/223 |
| 2,749,662 | 6/1956 | Bottleman | 46/223 |

FOREIGN PATENT DOCUMENTS

| | | | |
|---|---|---|---|
| 1603412 | 11/1969 | Fed. Rep. of Germany | 46/221 |
| 942487 | 11/1963 | United Kingdom | 46/221 |
| 1022798 | 3/1966 | United Kingdom | 46/221 |

*Primary Examiner*—Mickey Yu

*Attorney, Agent, or Firm*—Michael Ebert

[57] ABSTRACT

A toy vehicle whose body is a replica of a high performance vehicle such as a "Corvette," the body resting on a standardized sub-assembly composed of a rectangular chassis carrying front and rear wheel sets, the chassis fitting into the underside of the body regardless of its design. The chassis is provided adjacent either end with slotted side bearings which accommodate the axles of the front and rear wheel sets. These axles are locked into place by a flexible latching strip having a constricted neck dividing the strip into a short head section terminating in a raised step from which projects an upwardly inclined prow and a long tail section terminating in a raised step. Anchored on the bed of the chassis is a pair of parallel rails which define a longitudinal guide for the strip, the rails having upper flanges thereon forming a narrowed inlet for the neck to permit the strip to be received between the rails at an initial position at which the head section is displaced from the front axle and the tail section overlies the rear axle. By pushing the flexible strip forward to its latching position, the prow is caused to ride over the front axle to lift the head section and permit the head step to engage this axle, at which point the tail step engages the rear axle, thereby retaining the axles within their bearings.

9 Claims, 11 Drawing Figures

Fig. 5.
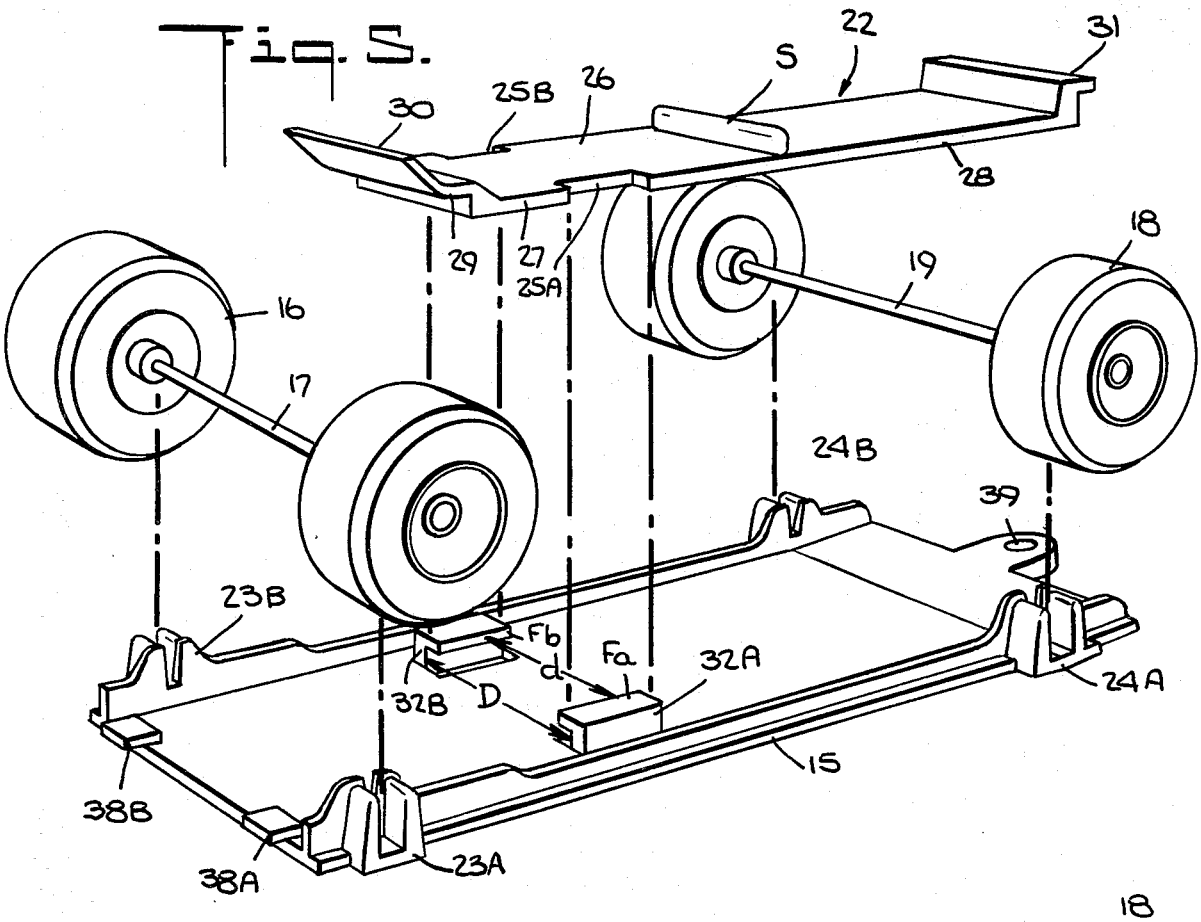
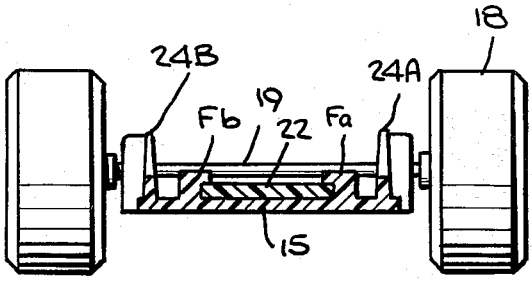
Fig. 8.
Fig. 4.
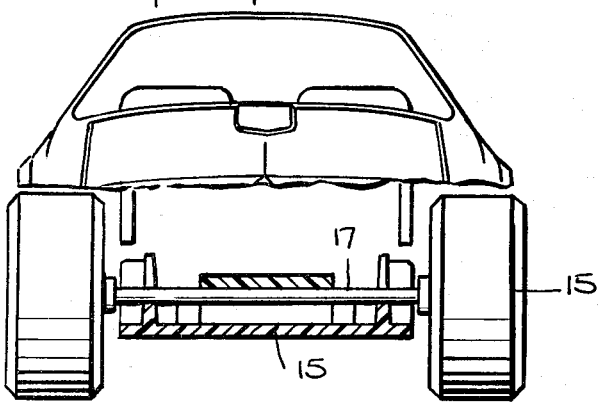

MINIATURE TOY VEHICLE ASSEMBLY

BACKGROUND OF INVENTION

This invention relates generally to miniature toy vehicles, and more particularly to a toy vehicle assembly in which a standardized sub-assembly constituted by a chassis carrying front and rear wheel sets is usable with a range of different body designs to create small scale replicas of classic high performance vehicles.

For many years, it has been the practice in the toy industry to market small-scale replicas of classic car models. These miniature vehicles, which are capable of running when pushed by the player, are realistic counterparts of actual models, for they simulate not only the body form but also the interior seating arrangement and dashboard as seen through the windows of the body. Such miniature vehicles have greater play value than toy vehicles whose body appearance is in no way related to full scale vehicles familiar to the players.

Thus among the well-known high performance cars are the "Corvette," the "Formula One Racer," the "Trans Am," the "GTO," the "280ZX" and the "Cutlass." Each of these classic models possesses a highly distinctive body and interior design that is immediately recognized by the typical car buff. In order, therefore, for a toy manufacturer to produce a range of small-scale vehicles simulating the above-listed vehicles, he must mold of plastic or fabricate in metal reasonably accurate replicas thereof.

The chassis of a vehicle is not visible to an observer; and the wheel sets of different models, apart from differences in hub ornamentation, are essentially the same. In order, therefore, to reduce the cost of manufacturing and assembling toy vehicles which are small-scale replicas of high performance vehicles, it is desirable to be able to standardize the chassis and wheel set sub-assembly which when joined to the body completes the car assembly.

Known forms of chassis and wheel set sub-assemblies for miniature toy vehicles are relatively complicated mechanically and costly to manufacture. Thus the Prodger et al. U.S. Pat. No. 3,653,149 shows a miniature toy vehicle that includes a box-like shallow chassis provided at its front and rear ends with a pair of axle clearance notches to receive the axles of the front and rear wheel sets. These wheel sets are supported on a suspension plate having axle-holding arms. In producing this sub-assembly, one must first secure the axles of the wheel set to the holding arms on the suspension plate, then screw the suspension plate to the chassis to complete the sub-assembly, after which the sub-assembly must in turn be secured to the underside of the car body.

SUMMARY OF INVENTION

In view of the foregoing, the main object of this invention is to provide a standardized chassis and wheel set sub-assembly for a miniature toy vehicle, which sub-assembly may be used in conjunction with a range of car bodies having different appearances.

More particularly, an object of this invention is to provide a sub-assembly of the above type in which the front and rear wheel sets are combined with the chassis without screws or other expedients which require tools, the wheel sets being held to the chassis by a latching strip which is pushed into a locking position.

Also an object of the invention is to provide a chassis and wheel set sub-assembly for a toy vehicle which is readily joined to the body thereof and locked thereto by a single screw, thereby greatly simplifying assembly procedures.

Briefly stated, these objects are attained in a toy vehicle whose body is a replica of a high performance vehicle such as a "Corvette," the body resting on a standardized sub-assembly composed of a rectangular chassis carrying front and rear wheel sets, the chassis fitting into the underside of the body regardless of its design. The chassis is provided adjacent either end with slotted side bearings which accommodate the axles of the front and rear wheel sets. These axles are locked into place by a flexible latching strip having a constricted neck dividing the strip into a short head section terminating in a raised step from which projects an upwardly inclined prow and a long tail section terminating in a raised step. Anchored on the bed of the chassis is a pair of parallel rails which define a longitudinal guide for the strip, the rails having upper flanges thereon forming a narrowed inlet for the neck to permit the strip to be received between the rails at an initial position at which the head section is displaced from the front axle and the tail section overlies the rear axle. By pushing the flexible strip forward to its latching position, the prow is caused to ride over the front axle to lift the head section and permit the head step to engage this axle, at which point the tail step engages the rear axle, thereby retaining the axles within their bearings.

OUTLINE OF DRAWINGS

For a better understanding of the invention as well as other objects and further features thereof, reference is made to the following detailed description to be read in conjunction with the accompanying drawings, wherein:

FIG. 3 is an elevational view partly in section in the plane indicated by lines 3—3 in FIG. 2, showing how the latching strip engages the front and rear axles of the wheel sets;

FIG. 4 is a section taken in the plane indicated by line 4—4 in FIG. 2;

FIG. 5 is an exploded view of the chassis sub-assembly;

FIG. 9 illustrates, in perspective, how the sub-assembly is joined to the body of the vehicle;

DESCRIPTION OF INVENTION

The Basic Structure

Figure 1:
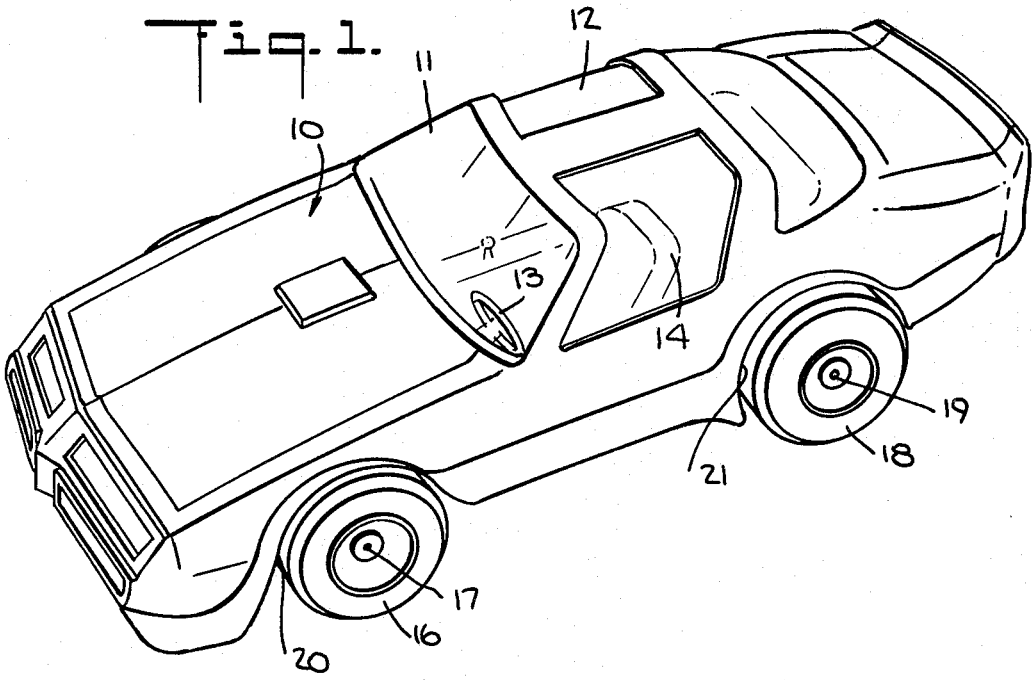
FIG. 1 is a perspective view of a miniature toy vehicle in accordance with the invention.
Figure 2:
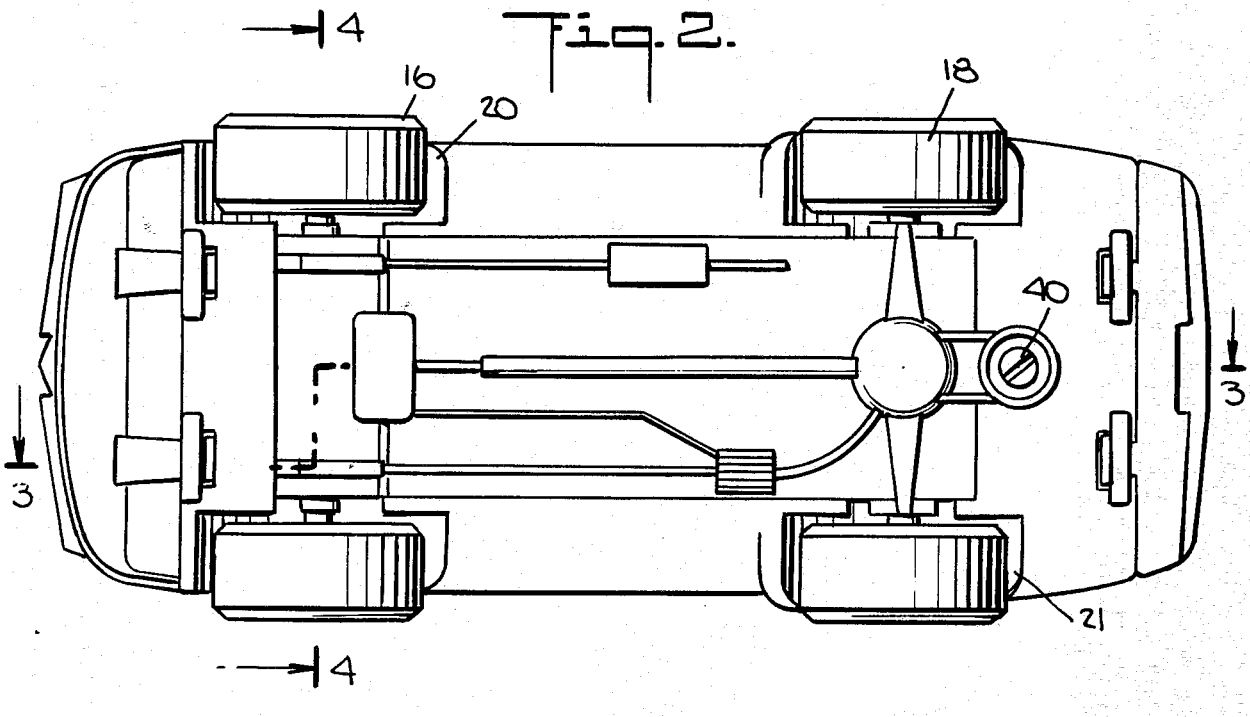
FIG. 2 is a view of the undercarriage of the vehicle.
Figure 8:
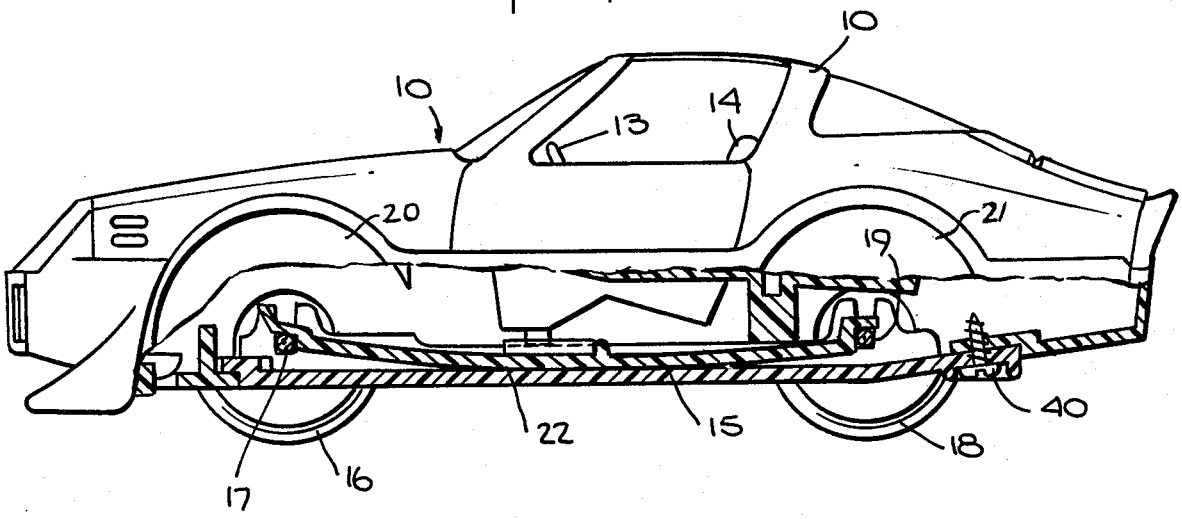
FIG. 8 is a transverse section taken through the sub-assembly shown in FIG. 7.

Referring now to FIGS. 1 to 4, there is shown a miniature toy vehicle in accordance with the invention which, by way of example, is a replica of a "TRANS AM" high performance car. It is to be understood that the invention is not limited to this model and is applicable to any model whose body, which has a distinctive design and interior, is adapted to rest on a standardized sub-assembly in the manner described below.

In the particular replica illustrated, the body 10 of the vehicle may be fabricated of a thin metal shell fitted over molded plastic parts which create on a small scale the grill, the bumpers and all other physical details of the vehicle being reproduced. Thus body 10 includes a transparent windshield 11 and windows 12 of plastic film through which are visible the steering wheel 13, the bucket seats 14 and other distinctive interior details of the TRANS AM model.

Body 10 rests on a sub-assembly composed of a rectangular chassis 15, a front wheel set 16 constituted by a pair of wheels rotating on a front axle 17, and a rear wheel set 18 constituted by a pair of wheels rotating on a rear axle 19. Wheels 16 and 18 are nested within arcuate cavities 20 and 21 formed in the body of the car. In the sub-assembly, the front and rear axles are locked in place by means of a latching strip 22 in a manner to be later described.

The Sub-Assembly

Referring now to FIG. 5, which separately shows the standardized sub-assembly, chassis 15, which is preferably molded of high-strength, rigid plastic material, such as polypropylene or polyvinyl chloride, is provided adjacent its front end with a pair of slotted side bearings 23A and 23B. These are adapted to receive axle 17 of the front wheel set 16, the axle simply being dropped into these bearings. Similarly, axle 19 of rear wheel set 18 drops into the slotted side bearings 24A and 24B adjacent the rear of the chassis.

Latching strip 22, which is normally flat and unflexed, is molded of flexible plastic material and indented on opposing sides by a pair of notches 25A and 25B to define a constricted neck 26 which divides the strip into a short head section 27 and a longer tail section 28. Head section 27 terminates in a raised step 29 from which projects an upwardly inclined prow 30. Tail section 28 terminates in a raised step 31.

Figure 6:
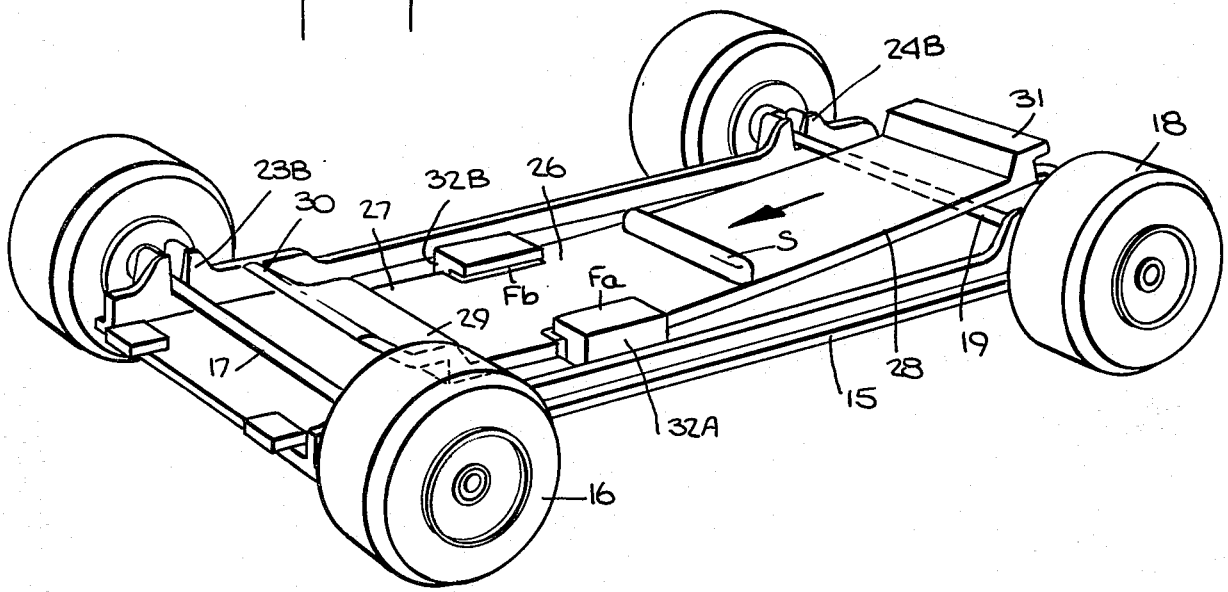
FIG. 6 is a perspective view of the chassis sub-assembly.
Figure 7:
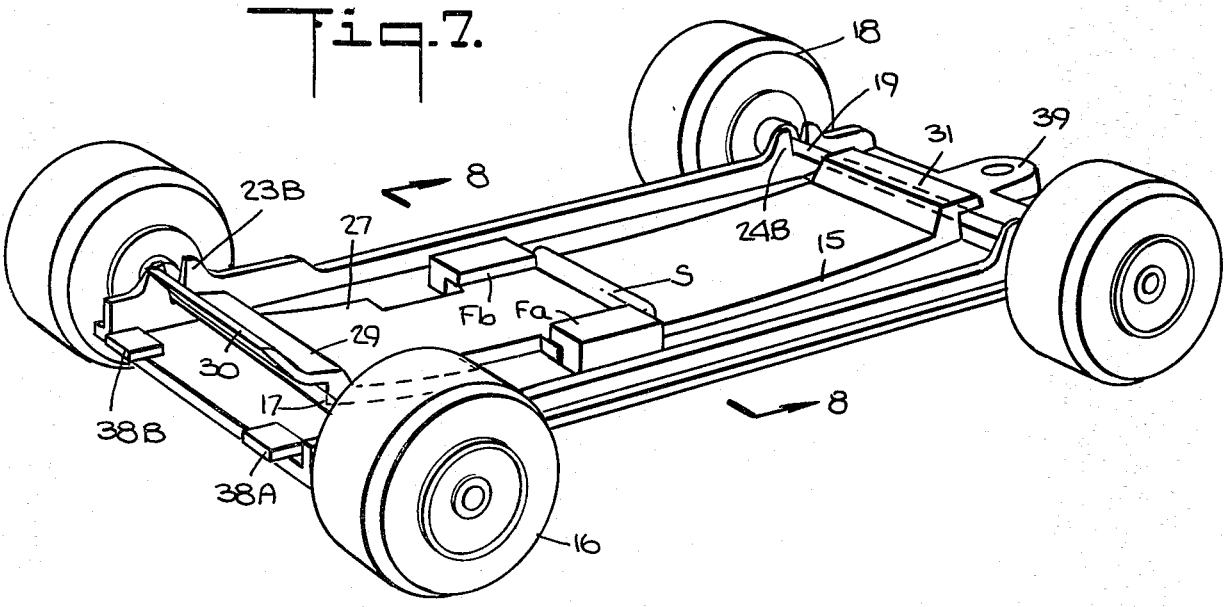
FIG. 7 is the same as FIG. 6, but with the latching strip in its locking position.
Figure 8:
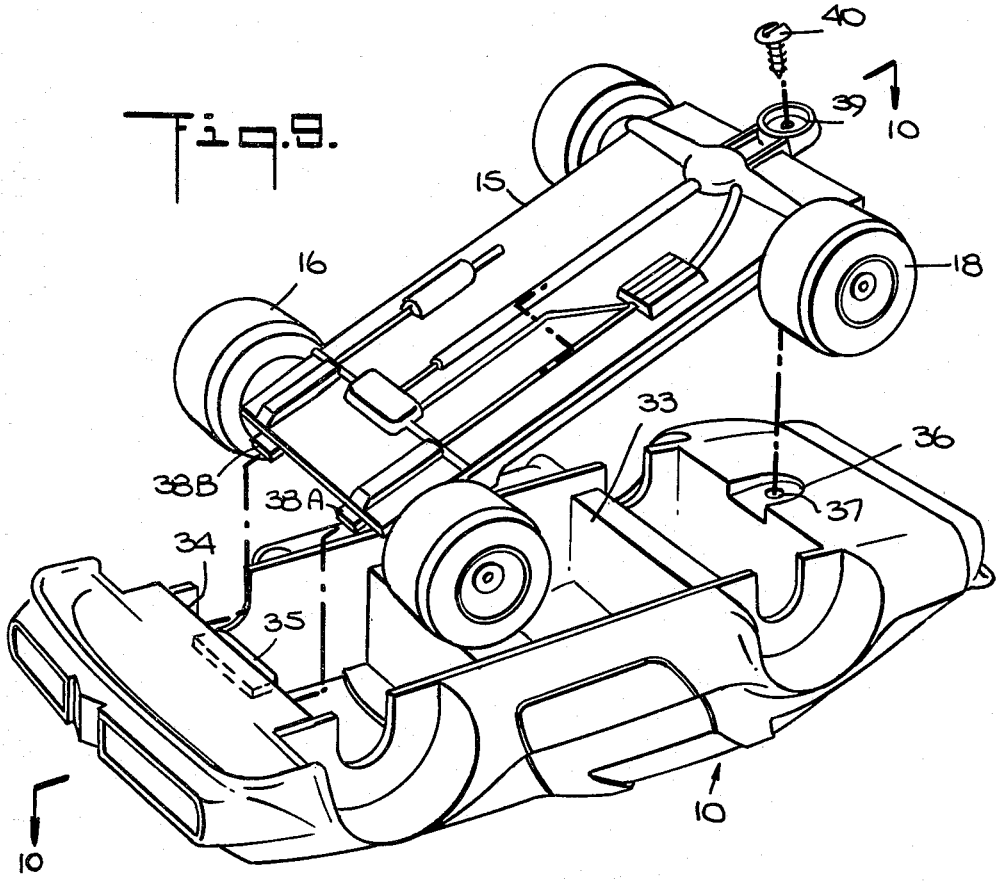

Anchored on the bed of chassis 15 is a pair of parallel rails 32A and 32B which are spaced apart by a distance D slightly greater than the width of strip 12 to form a longitudinal guide therefor. Rails 32A and 32B are provided with inwardly-directed upper flanges $F_a$ and $F_b$ which form a narrowed inlet having a width d which is slightly larger than the width of neck 26 of the latching strip. Thus the strip may be dropped through this inlet onto the bed of chassis 15 between the rails to assume the initial non-latching position shown in FIG. 6.

In this initial position, head section 27 of the strip is displaced inwardly from front axle 17, whereas the tail section 28 overlies rear axle 19. To lock the axles into their respective bearings, one has merely to push the strip forward, as indicated by the arrow in FIG. 6, until the transverse stop S formed on the strip abuts flanges $F_a$ and $F_b$ on the rails, which is the latching position.

In the course of this forward movement, the inclined prow 30 is caused to ride over front axle 17 to lift the head section to permit front step 29 to engage the front axle, at which point rear step 31 then engages rear axle 19, thereby retaining the axles in their respective bearings. Since flanges $F_a$ and $F_b$ hold the intermediate portion of the strip within the guide against the bed of the chassis, the front and rear portions of the strip must flex upwardly to permit the front and rear steps to engage the axles, thereby producing downward pressure on the axles.

The Final Assembly

Figure 10:
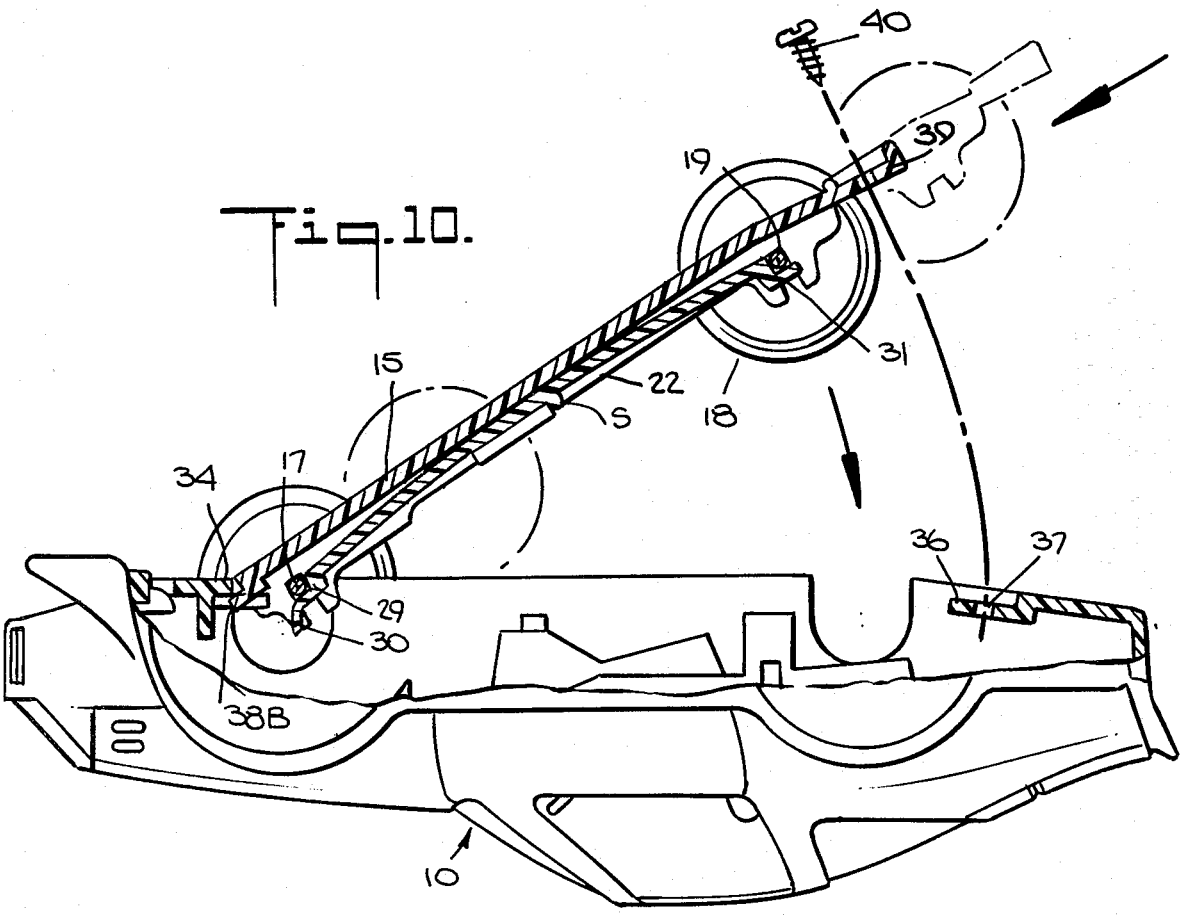
FIG. 10 is a longitudinal section taken in the plane indicated by line 10—10 in FIG. 9.

In order to fit the standardized chassis sub-assembly to the body 10 of the vehicle, the underside of the body, as shown in FIGS. 9 and 10, is formed with a rectangular socket or well 33 whose front border is defined by a ledge 34. Just under the ledge at its midpoint and projecting into the well is a locating lug 35. The rear border of socket 33 is formed with a central recess 36 having a threaded bore 37.

Figure 11:
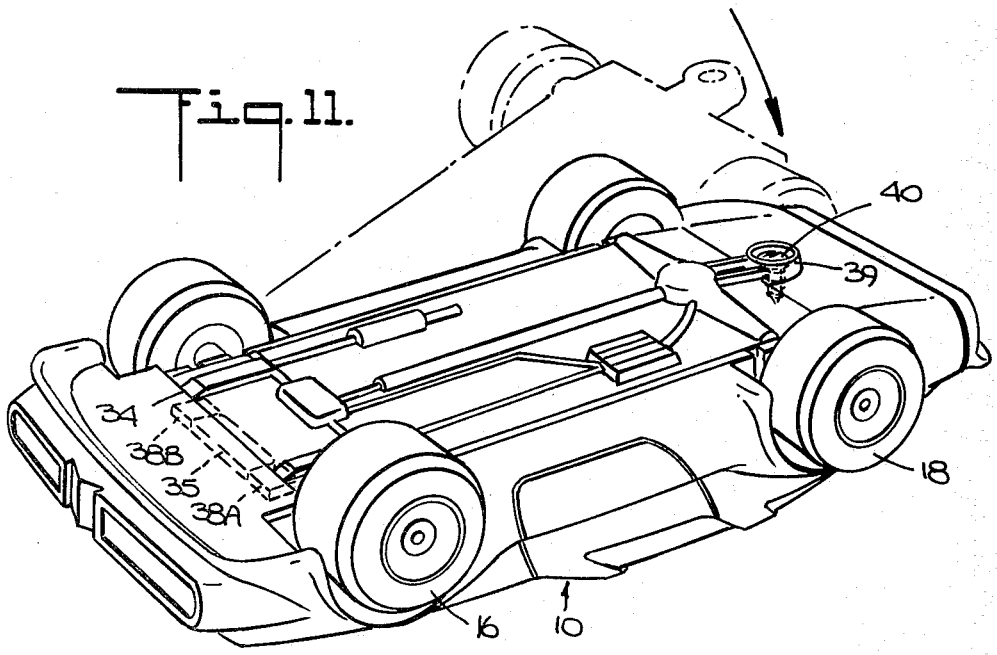
FIG. 11 is a perspective view showing how the sub-assembly is locked to the body of the vehicle by a single screw.

The front end of chassis 15 is provided with a pair of spaced projecting fingers 38A and 38B which are received under ledge 34 on either side of locating lug 35. The rear end of chassis 15 is provided at its center with a projecting ring 39 which, when the chassis is fitted into socket 33, as shown in FIG. 11, is seated within recess 36, at which point a screw 40 is inserted through the ring into bore 37 and turned to lock the chassis in place.

Thus, as best seen in FIG. 10, to join the chassis sub-assembly to body 10 of the vehicle, one first places fingers 38A and B under front ledge 34 of the socket to provide a pivot axis for the sub-assembly which is then swung down to carry ring 39 into recess 36. Screw 40 is then inserted to lock the chassis.

Thus, the assembly operation is exceptionally simple and may be performed very quickly. First the operator drops the axles of the front and rear wheel sets into their bearings on the chassis; he then drops the neck of the latching strip into the inlet of the guide rails and pushes the strip forward to lock the axles of the wheel sets in their bearings, thereby completing the sub-assembly. Now he takes the completed sub-assembly and swings it into the well on the underside of the body and locks it in place with a single screw—the total operation taking a few seconds and virtually no skill.

While there has been shown and described a preferred embodiment of a miniature toy vehicle assembly in accordance with the invention, it will be appreciated that many changes and modifications may be made therein without, however, departing from the essential spirit thereof.

I claim:

1. A miniature toy vehicle comprising:

(A) a body formed into a small-scale replica of a given high-performance vehicle, said body having in its underside a rectangular well;

(B) a standardized sub-assembly on which said body is adapted to rest regardless of its form, said sub-assembly including a rectangular chassis dimensioned to fit into said well and having front and rear slotted side bearings, front and rear axled wheel sets whose axles drop into the slots of the respective side bearings, and a flexible latching strip to retain said axles in said bearings, said strip having a constricted neck dividing the strip into a short head section and a longer tail section, the head section terminating in a raised step from which projects an upwardly inclined prow, said tail section terminating in a raised step, the bed of said chassis having a pair of parallel rails thereon to form a longitudinal guide for the strip, said rails having upper flanges to define a narrowed inlet to receive said neck and to place said strip on said bed at an initial position at which the head section is displaced inwardly from the front axle and the tail section overlies the rear axle, which strip when pushed forward toward a latching position causing the prow to ride over the front axle to lift the head section to permit the front step to engage the front axle, at which point the rear step engages the rear axle.

2. A toy vehicle as set forth in claim 1, wherein said body is formed with a shaped metal shell covering molded plastic components which define the interior of the vehicle and all other elements of the body.

3. A toy vehicle as set forth in claim 2, wherein said body is provided with arcuate cavities to accommodate the wheels of the front and rear sets.

4. A toy vehicle as set forth in claim 3, wherein said body is provided with transparent plastic film windows and a windshield to expose the interior to a viewer.

5. A toy vehicle as set forth in claim 1, wherein said strip is formed of flexible synthetic plastic material.

6. A toy vehicle as set forth in claim 1, wherein said strip is provided with a stop which arrests movement of said strip at the latching position.

7. A toy vehicle as set forth in claim 1, wherein said chassis is provided with projecting fingers at the front end thereof which are received below a ledge defining the front border of said well to pivot said chassis therefrom, the rear end of the chassis having a ring projecting therefrom which is received in a recess having a threaded bore in the rear border of the well, into which ring a screw may be inserted to be turned into the bore to lock said sub-assembly to the body.

8. A standardized sub-assembly adapted to be coupled to the body of a miniature toy vehicle which is a small-scale replica of a given high performance vehicle, said body having a rectangular well on its underside, said sub-assembly comprising:

A. a rectangular chassis dimensioned to fit into said well and having front and rear slotted side bearings and a strip guide placed on the bed of the chassis at a position intermediate said side bearings;

B. front and rear axled wheel sets whose axles drop into the slots of the respective side bearings; and C. a flexible latching strip having an indentation therein which is longitudinally shiftable within said guide from an initial non-latching position in which said indentation registers with the guide to render the strip free of said guide to a latching position in which the indentation is out of registration with the guide and the respective ends of the strip engage the front and rear axles.

9. A sub-assembly as set forth in claim 8, wherein said ends are provided with raised steps which engage said axles.

* * * * *